US009884408B1

(12) United States Patent
Mikulich

(10) Patent No.: US 9,884,408 B1
(45) Date of Patent: Feb. 6, 2018

(54) POOL PUMP-TRAP WRENCH SYSTEMS

(71) Applicant: Clement Mikulich, Peoria, AZ (US)

(72) Inventor: Clement Mikulich, Peoria, AZ (US)

( * ) Notice: Subject to any disclaimer, the term of this patent is extended or adjusted under 35 U.S.C. 154(b) by 166 days.

(21) Appl. No.: 15/093,308

(22) Filed: Apr. 7, 2016

Related U.S. Application Data

(60) Provisional application No. 62/168,786, filed on May 30, 2015.

(51) Int. Cl.

| | |
|---|---|
| ***B25B 13/06*** | (2006.01) |
| ***B25B 13/50*** | (2006.01) |
| ***B25G 1/10*** | (2006.01) |
| ***B25B 13/08*** | (2006.01) |

(52) U.S. Cl.
CPC ..... *B25B 13/08* (2013.01); *B25B 13/50* (2013.01); *B25G 1/102* (2013.01); *B25G 1/105* (2013.01)

(58) Field of Classification Search
USPC ..... 81/176.1
See application file for complete search history.

(56) References Cited

U.S. PATENT DOCUMENTS

| | | | | |
|---|---|---|---|---|
| 1,321,776 | A | 11/1919 | Speanian | |
| 2,408,233 | A | 9/1946 | Smith | |
| 4,252,249 | A | 2/1981 | Beckhardt et al. | |
| 5,896,785 | A * | 4/1999 | Shaw | B25B 27/0042 81/121.1 |
| 6,237,797 | B1 * | 5/2001 | Hurford | B60K 15/0406 220/212.5 |
| 7,267,031 | B1 * | 9/2007 | Burton | B67B 7/18 81/3.09 |
| 7,810,413 | B2 * | 10/2010 | Liu | B25B 15/008 81/177.2 |
| 8,347,767 | B2 | 1/2013 | Whitaker et al. | |
| 9,016,170 | B2 * | 4/2015 | Nelson | B67B 7/44 7/151 |
| 2012/0102702 | A1 | 5/2012 | Mitchell | |
| 2013/0047793 | A1 | 2/2013 | Hamby et al. | |

* cited by examiner

*Primary Examiner* — Hadu Shakeri
(74) *Attorney, Agent, or Firm* — Integrity Patent Group, PLC; Edwin Wold

(57) ABSTRACT

A pool pump-trap wrench system including a pool pump-trap wrench assembly. The pool pump-trap wrench assembly including, a handle-frame, a top-unit, and two offset-lower-levers. The handle-frame, the a top-unit, and the two offset-lower-levers are structured and arranged in combination to provide a user with a device useful for affixing to a wide variety of pool pump-trap covers for cleaning and maintaining a the pool pump-trap. The handle-frame includes a handle and a frame. The frame includes a frame-opening, at least one frontward-notch, and at least one rearward-notch. Included is the top unit including a front-member, a rear-member, and a center-section; with the center-section including a body and a body-opening. The handle-frame includes the handle; the frame includes the frame-opening, the at least one frontward-notch, and the at least one rearward-notch; where the top-unit includes the front-member, the rear-member.

18 Claims, 7 Drawing Sheets

POOL PUMP-TRAP WRENCH SYSTEMS

CROSS-REFERENCE TO RELATED APPLICATION

The present application is related to and claims priority from prior provisional application Ser. No. 62/168,786, filed May 30, 2015 which application is incorporated herein by reference.

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of hand tools and more specifically relates to pool pump-trap wrench systems.

2. DESCRIPTION OF RELATED ART

Generally, a hand tool is powered manually, by an individual and not by an external power source (e.g., electricity, hydraulic, fuel-powered engine/motor). Some common examples of such hand tools are garden pitchforks, rakes, hammers, pliers, screwdrivers, chisels, and wrenches. Hand tools are generally easier and safer to use than power tools. Hand tools have been made and used by humans beginning in the Stone Age. During the Bronze and Iron Ages tools were beginning to be made by casting basic metal alloys to create metallic tools. Metallic-type tools were harder, more durable and sharper than the previous Stone Age tools. Tools of the modern era are made from a wide variety of metals, plastics, ceramics, and other materials depending on the manufacturing method, specific requirements of the tool, and price optimization.

One commonly used hand tool is a wrench. Generally speaking, a wrench used to tighten and/or loosen an object (i.e., torque and untorque). A wrench may be a very general tool with a wide variety of applications, such as an adjustable wrench. Other wrenches may be highly specialized to tighten and loosen specific fasteners or covers. One limitation with adjustable wrenches is that they often lead to increased wear on the device or fasteners being repeatedly tightened and loosened, and specialized wrenches often are limited in their application.

In warmer climates, pools are often a popular to provide recreation, exercise, socialization and other similar outdoor activities. There are currently more than 10 million residential pools and more than 300,000 public swimming pools in the United States. Most modern pools utilize a system of pump(s), filter(s), and trap(s) to maintain water quality by circulating water and contaminates by pump to filter and trap, with a wide variety of different pool and pump manufacturers. In many instances, a different manufacturer may require a different type of tool (e.g., wrench) to maintain, disassemble, and/or clean the filter, pump, and/or pump-trap. Some equipment-specific tools are available and some equipment may be maintained and/or cleaned by the use of adjustable tools.

Using an equipment-specific tool may be cumbersome for maintenance personnel, as the personnel may need to carry a wide variety of tools; and often, adjustable tools may provide for excess wear on the equipment. Therefore, a suitable solution is desired.

Several attempts have been made to solve the above-mentioned problems such as those found in U.S. Pub. No. 2013/0047793 to Hamby et al., 2012/0102702 to Mitchell, U.S. Pat. No. 1,321,776 to Stepanian, U.S. Pat. No. 2,408,233 to Smith, U.S. Pat. No. 4,252,249 to Beckhardt et al., and U.S. Pat. No. 8,347,767 to Whitaker et al. This art is representative of hand tools. However, none of the above inventions and patents, taken either singly or in combination, is seen to describe the invention as claimed.

Preferably, a pool pump-trap wrench system should provide a means for individual to utilize a single tool to replace, disassemble, maintain, and/or clean a wide variety of pool equipment and, yet would operate reliably and be manufactured at a modest expense. Thus, a need exists for a reliable pool pump-trap wrench system to avoid the above-mentioned problems.

BRIEF SUMMARY OF THE INVENTION

In view of the foregoing disadvantages inherent in the known hand tools art, the present invention provides a novel pool pump-trap wrench system. The general purpose of the present invention, which will be described subsequently in greater detail is to provide a single tool which accommodates many different manufacturers of pool equipment, including pool pump-traps, in a compact and lightweight tool with an ergonomic design.

A pool pump-trap wrench system is disclosed herein, in a preferred embodiment, comprising a pool pump-trap wrench assembly. The pool pump-trap wrench assembly comprising at least, a handle-frame, a top-unit, and two offset-lower-levers in functional and structural combination. The handle-frame, the a top-unit, and the two offset-lower-levers are structured and arranged in combination to provide a user with a device useful for affixing to a wide variety of pool pump-trap covers for cleaning and maintaining a the pool pump-trap. The pump-trap upon which the pool pump-trap wrench system may be use may be independent from a pool pump volute, or may be integral with the pool pump volute.

The preferred embodiment includes the handle-frame comprised of a handle and a frame. The frame including a frame-opening, at least one frontward-notch, and at least one rearward-notch. The preferred embodiment also includes the top unit comprised of a front-member, a rear-member, and a center-section; with the center-section comprising a body and a body-opening. The handle-frame comprises the handle, and the frame in functional and structural combination; the frame comprises the frame-opening, the at least one frontward-notch, and the at least one rearward-notch in functional and structural combination; where the top-unit comprises the front-member, the rear-member, and the center-section in functional and structural combination.

The handle of the handle-frame may further includes a texture to provide the user with increased grippability during use of the pool pump-trap wrench assembly and the handle-frame may further include an aperture to allow the user to hang the pool pump-trap assembly for storage and easy access or to allow the user to affix a lanyard or other similar object. The preferred embodiment of the handle-frame is configured in a semi-arch-shape to enhance comfort and ergonomics for the user and to increase structural integrity during use.

The preferred embodiment includes a handle-frame including reinforcing veins to further increase structural rigidity and durability of the entire tool. Additionally, the preferred embodiment includes the top-unit with a plurality of first-openings to decrease the overall mass of the pool pump-trap wrench assembly and the top-unit may further include at least one button, the button useful for providing increased affixability to at least one of the pool pump-trap covers. Similarly, the handle-frame may further include a plurality of second-openings to decrease the overall mass of the pool pump-trap wrench assembly. The two offset-lower-levers further include a textured-face to enhance affixability to at least one of said pool pump-trap covers, in the preferred embodiment.

The preferred embodiment of the pool pump-trap wrench system may comprise the pool pump-trap wrench system constructed of a single-molded material, which may be constructed of a plastic material such that said pool pump-trap wrench system and pool pump-trap wrench assembly are lightweight. The preferred embodiment may include plastic materials which are formulated to be resistant to ultra-violet light degradation.

The pool pump-trap wrench system may comprise a kit including a pool pump-trap wrench assembly and a set of user instructions. A method of using a pool pump-trap wrench system may include the steps of locating a pool pump-trap covers, affixing the pool pump-trap wrench assembly to the pool pump-trap cover, untorquing the pool pump-trap cover by use of the pool pump-trap wrench assembly and removing the pool pump-trap cover. The method of use may also include the optional steps of cleaning and maintaining the pool pump-trap, replacing said pool pump-trap cover onto the pool pump-trap, re-torquing the pool pump-trap cover by use of the pool pump-trap wrench assembly, and removing the pool pump-trap wrench assembly from the pool pump-trap cover.

The present invention holds significant improvements and serves as a pool pump-trap wrench system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, pool pump-trap wrench system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a hand tools and more particularly to a pool pump-trap wrench systems as used to improve the ease of use by reducing the number of devices required for cleaning and maintaining a wide variety of pool pump-traps. Generally speaking, a pool pump-trap wrench system is comprised of a pool pump-trap wrench assembly as described subsequently.

Figure 1:
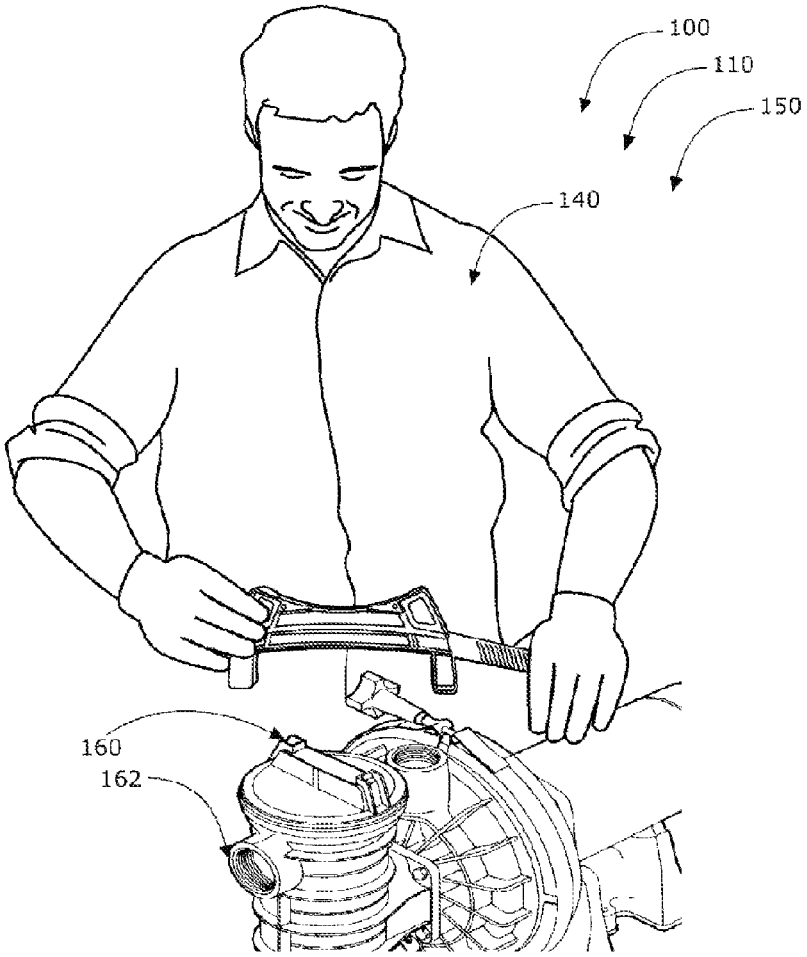
FIG. 1 shows a perspective view illustrating a pool pump-trap wrench system during an 'in-use' condition showing a user using a pool pump-trap wrench system to maintain a pool pump-trap according to an embodiment of the present invention.

Referring to the drawings by numerals of reference there is shown in FIG. 1, an 'in use' condition 150 of pool pump-trap wrench system 100 whereby user 140 is placing pool pump-trap wrench assembly 110 upon pool pump-trap cover 160 to begin maintenance and/or cleaning of a pool pump-trap 162. Method of manufacture of pool pump-trap wrench system 100 may include construction by use of a single-molded material. Other method of manufacture may include a three-dimensional printing process. Such single mold materials may include a plastic to be lightweight, non-ferrous or ferrous metals for durability, or other materials dependent upon user specifications and preferences. Plastics of other materials for construction of pool pump-trap wrench system 100 may include materials resistant to ultra-violet light degradation.

Figure 2:
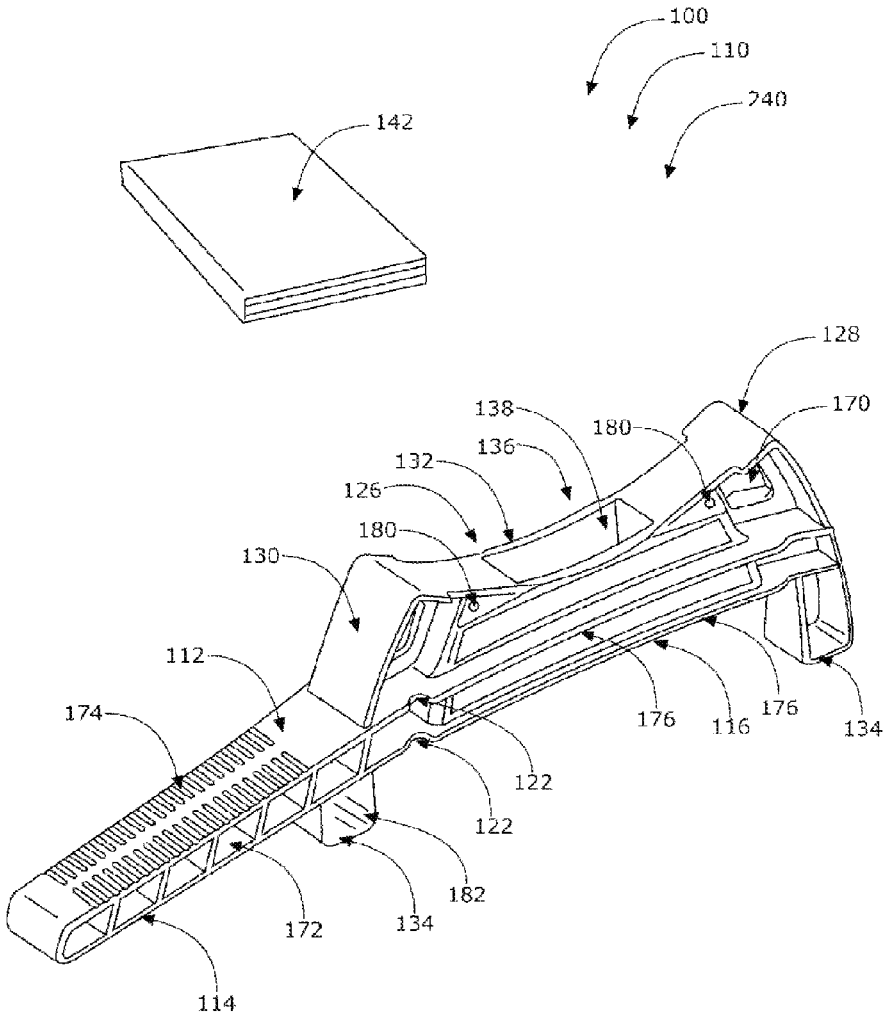
FIG. 2 is a top-perspective view illustrating the pool pump-trap wrench system comprising a pool pump-trap wrench assembly according to an embodiment of the present invention of FIG. 1.
Figure 3:
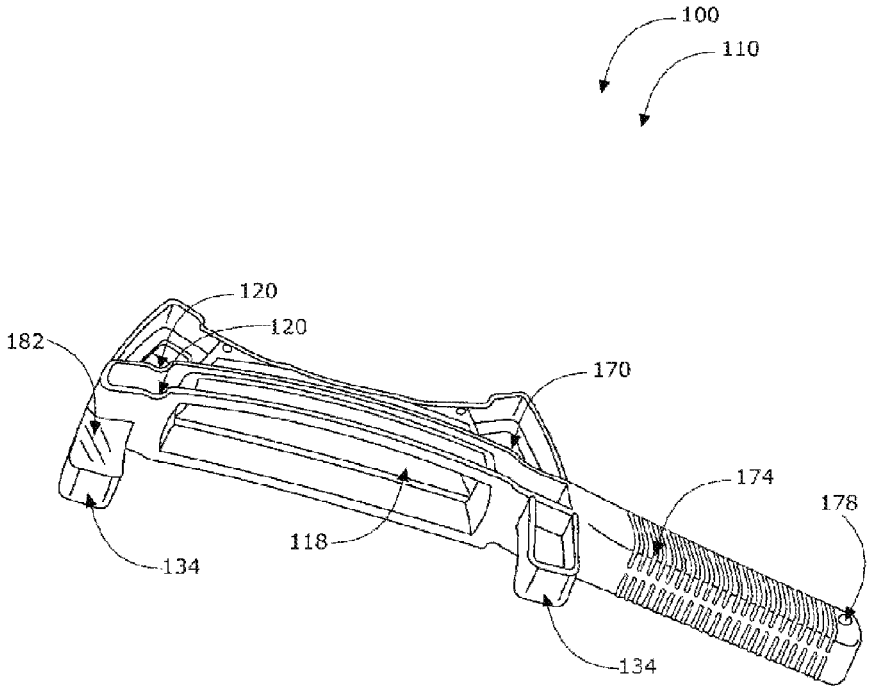
FIG. 3 is a bottom-perspective view illustrating the pool pump-trap wrench assembly according to an embodiment of the present invention of FIGS. 1-2.
Figure 4A:
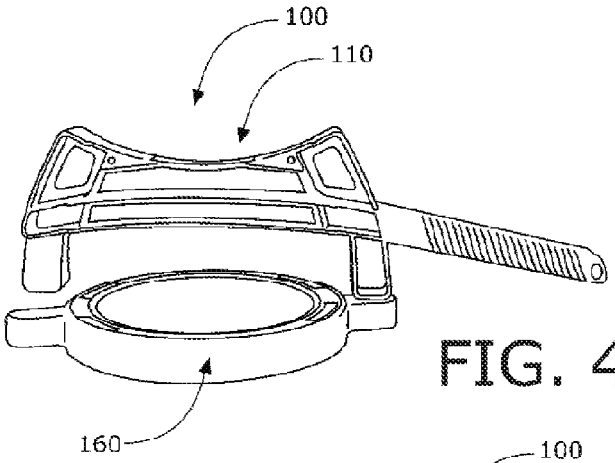
FIGS. 4*a*-6*b* are a perspectives view illustrating the pool pump-trap wrench system and a variety of pool pump-trap covers according to an embodiment of the present invention of FIGS. 1-3.
Figure 4B:
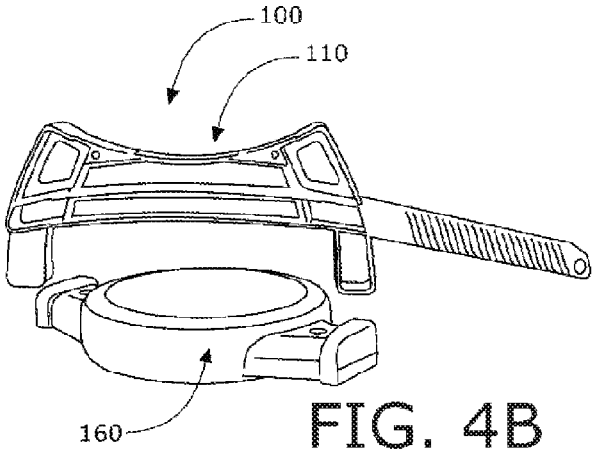
Figure 4C:
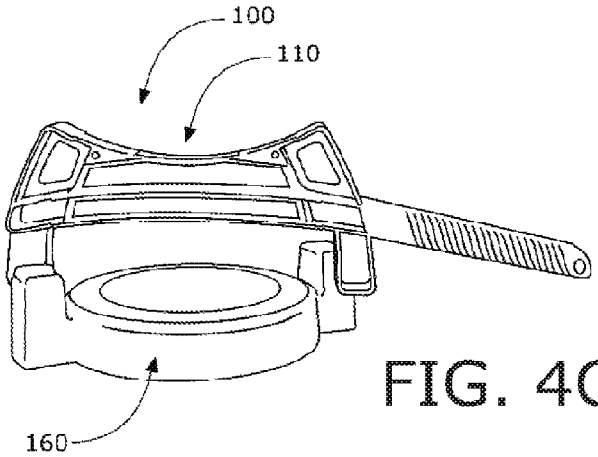
Figure 5A:
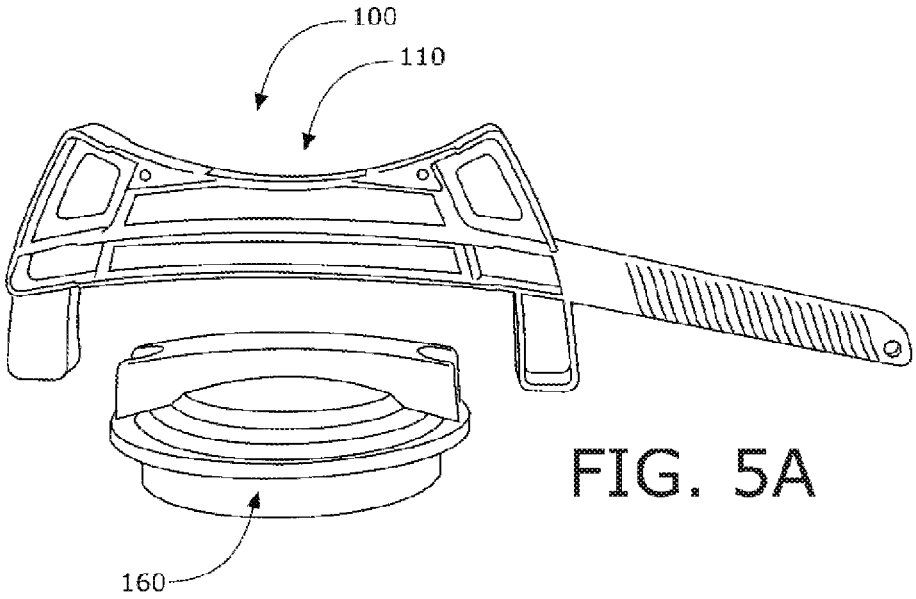
Figure 5B:
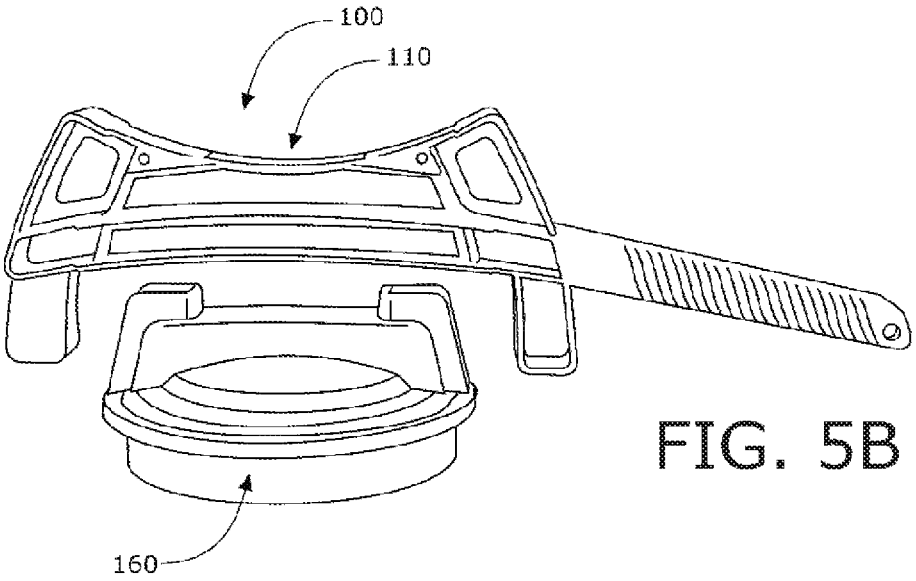
Figure 6A:
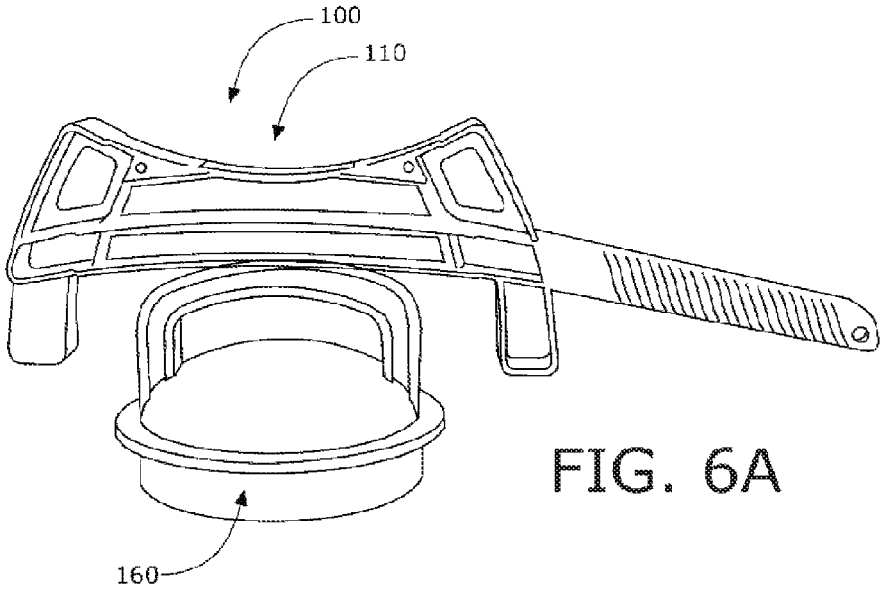
Figure 6B:
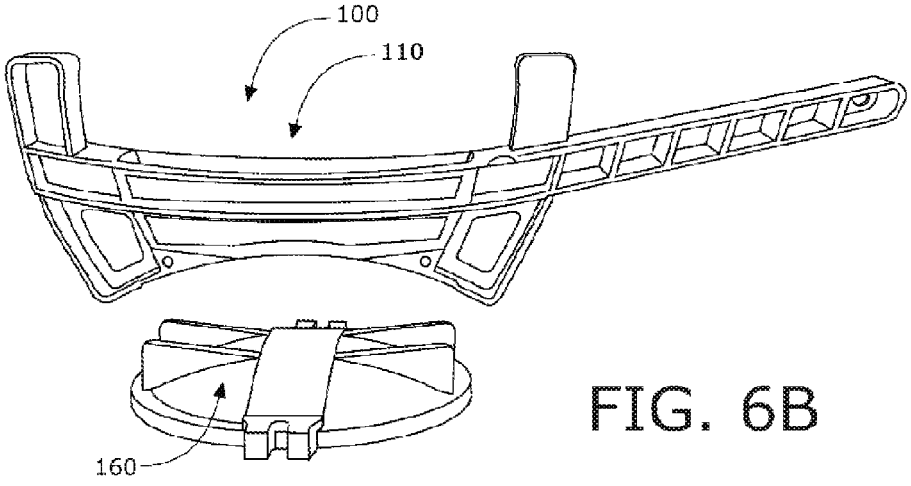

Referring now to FIG. 2 and FIG. 3, pool pump-trap wrench system 100 comprises pool pump-trap wrench assembly 110. Pool pump-trap wrench assembly 110 comprises handle-frame 112, top-unit 126, and two offset-lower-levers 134 in functional and structural combination. Handle-frame 112 comprises handle 114 and frame 116, with frame 116 comprising frame-opening 118, least one frontward-notch 120, and least one rearward-notch 122, in functional and structural combination. Top-unit 126 comprises front-member 128, rear-member 130, and center-section 132; with center-section 132 comprising body 136 and body-opening 138 in functional and structural combination.

Still referring to FIGS. 2-3, handle 114 of handle-frame 112 may further include texture 174 to provide user with increased grippability during use of pool pump-trap wrench assembly 110. Handle-frame 112 may further include aperture 178 to allow user to hang pool pump-trap wrench assembly 110 for storage and handle-frame 112 may further include reinforcing veins 176 to additionally increase structural rigidity and durability of pool pump-trap wrench assembly 110. Top-unit 126 may additionally include plurality of first-openings 170 to decrease the overall mass of pool pump-trap wrench assembly 110 and may further include at least one button 180 useful for providing increased affixability to at least one of pool pump-trap covers 160. Handle-frame 112 may further include plurality of second-openings 172 to further decrease the overall mass of pool pump-trap wrench assembly 110. Handle 114 of handle-frame 112 may be configured in a semi-arch-shape to enhance comfort and ergonomics for user 140.

Each of the two offset-lower-levers 134 may further include textured-face 182 to enhance affixability by increasing friction to at least one of pool pump-trap covers 160. Pool pump-trap wrench assembly 110 may further comprises a distinct color-coding of select surfaces to provide user 140 with a quick-reference as to a specific placement of pool pump-trap wrench system 100 on each of one of pool pump-trap covers 160.

Referring now to FIGS. 4*a*-6*b*, pool pump-trap wrench system 100 provides user with a device useful for affixing to a wide variety of pool pump-trap covers 160 for cleaning and maintaining the pool pump-trap. Such pool pump-trap and pool pump-trap covers include, without limitation, manufacturer's model numbers: Pentair Whisper Flow and Intelli Flow model 357150, Hayward Super II model SPX 3100D, Stay Rite Dyna Glass and Dyna Max model C3139P, Stay Rite Dura Class II and Maxi Glass II model C3185P, Hayward Echo Star and Tri Star model SPX 3200DLS, Hayward Super II model SPX 3000D, 'Old Style' Hayward North Star model SPX 4000CLD, and Pentair Challenger Pump model 355301.

Referring now to specifically to FIG. 2, showing pool pump-trap wrench system 100. Pool pump-trap wrench system 100 may be sold as kit 240 comprising the following parts: at least one pool pump-trap wrench assembly 110 and at least one set of user instructions 142. The kit has instructions such that functional relationships are detailed in relation to the structure of the invention (such that the invention can be used, maintained, or the like in a preferred manner). Pool pump-trap wrench 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different orientations, parts may be sold separately, etc., may be sufficient.

Figure 7:
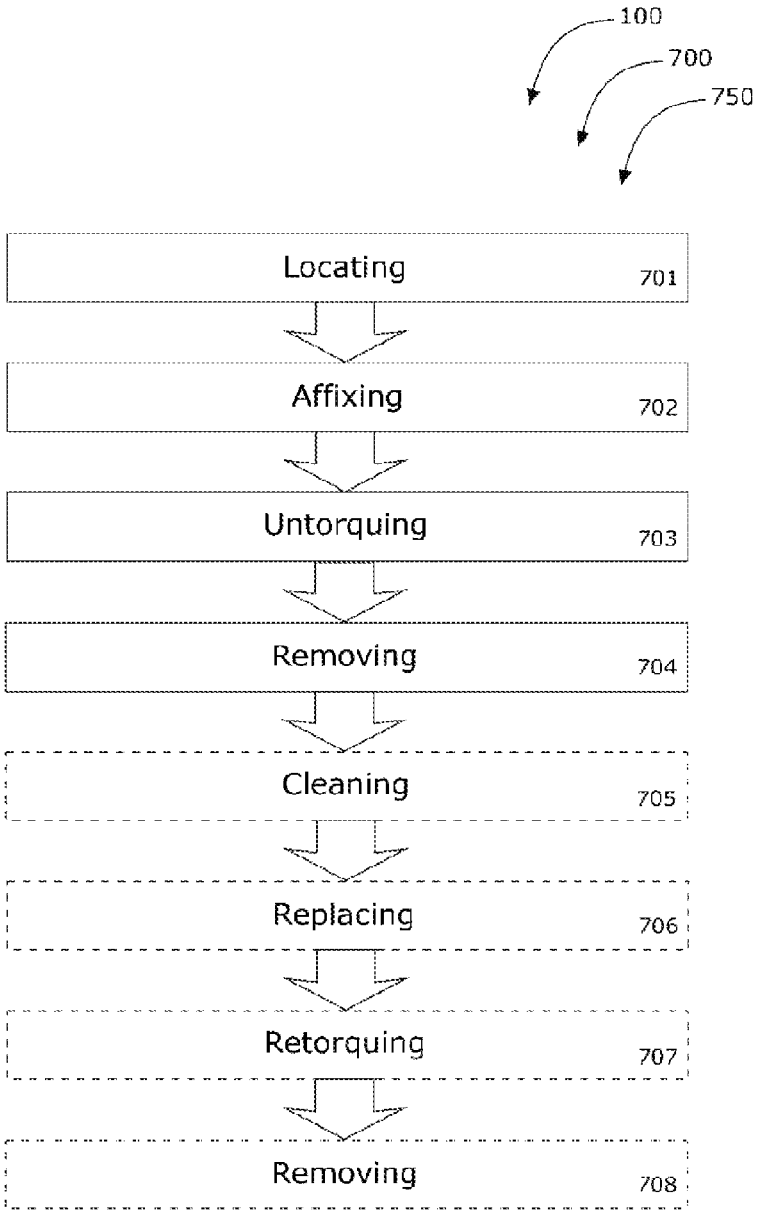
FIG. 7 is a method of use for a pool pump-trap wrench system according to an embodiment of the present invention of FIGS. 1-6*b*.

Referring now to FIG. 7 showing flowchart 750 illustrating method of use 700 for pool pump-trap wrench 100 according to an embodiment of the present invention of FIGS. 1-6*b*. As shown, method of use 700 may comprise the steps of: step one 701, locating one of pool pump-trap covers 160; step two 702, affixing pool pump-trap wrench assembly 110 to pool pump-trap cover 160; step three 703, untorquing pool pump-trap cover 160 via pool pump-trap wrench assembly 110; step four 704, removing pool pump-trap cover 160; step five 705, cleaning and maintaining pool pump-trap 162; step six 706, replacing pool pump-trap cover 160 onto pool pump-trap 162; step seven 707, retorquing pool pump-trap cover 160 via pool pump-trap wrench assembly 110; and step eight 708, removing pool pump-trap wrench assembly 110 from pool pump-trap cover 160.

It should be noted that step five 705, step six 706, step seven 707, and step eight 708 are optional steps and may not be implemented in all cases. Optional steps of method of use 700 are illustrated using dotted lines in FIG. 7 so as to distinguish them from the other steps of method of use 700.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A pool pump-trap wrench system for cleaning and maintaining a wide variety of pool pump-traps comprising:

a pool pump-trap wrench assembly comprising;

a handle-frame comprising a handle; and a frame including a frame-opening for accommodating a portion of a pool pump-trap cover, at least one frontward-notch, and at least one rearward-notch;

a top-unit comprising a front-member and a rear-member configured for engaging portions of a pool pump-trap cover, and a center-section comprising a body, a body-opening, and at least one button for providing increased affixability to a pool pump-trap cover; and two offset-lower-levers each comprising a textured-face to enhance affixability to a pool pump-trap cover;

wherein said pool pump-trap wrench system comprises said pool pump-trap wrench assembly; wherein said pool pump-trap wrench assembly comprises said handle-frame, said top-unit, and said two offset-lower-levers in functional and structural combination; wherein said handle-frame comprises said handle, and said frame in functional and structural combination; wherein said frame comprises said frame-opening, said at least one frontward-notch, and said at least one rearward-notch in functional and structural combination; wherein said top-unit comprises said front-member, said rear-member, and said center-section in functional and structural combination; and wherein said handle-frame, said a top-unit, and said two offset-lower-levers are structured and arranged in combination to provide a user with a device useful for affixing to a wide variety of pool pump-trap covers for cleaning and maintaining a pool pump-trap.

2. The pool pump-trap wrench system of claim 1 wherein said pool pump-trap wrench assembly is constructed of a single-molded material.

3. The pool pump-trap wrench system of claim 2 wherein said single-molded material is a plastic such that said pool pump-trap wrench system is lightweight.

4. The pool pump-trap wrench system of claim 3 wherein said plastic is formulated to be resistant to ultra-violet light degradation.

5. The pool pump-trap wrench system of claim 2 wherein said single-molded material is aluminum to provide for durability and longevity.

6. The pool pump-trap wrench system of claim 5 wherein said single-molded material is non-ferrous to avoid corrosion.

7. The pool pump-trap wrench system of claim 1 wherein said pool pump-trap wrench assembly is constructed via a three-dimensional printing process.

8. The pool pump-trap wrench system of claim 1 wherein said handle of said handle-frame further includes a texture to provide said user with increased grippability during use of said pool pump-trap wrench assembly.

9. The pool pump-trap wrench system of claim 1 wherein said handle-frame further comprises an aperture to allow said user to hang said pool pump-trap wrench assembly for storage.

10. The pool pump-trap wrench system of claim 1 wherein said handle-frame further comprises reinforcing veins to further increase structural rigidity and durability.

11. The pool pump-trap wrench system of claim 1 wherein said top-unit further includes a plurality of first-openings to decrease an overall mass of said pool pump-trap wrench assembly.

12. The pool pump-trap wrench system of claim 11 wherein said handle-frame further comprises a plurality of second-openings to decrease an overall mass of said pool pump-trap wrench assembly.

13. The pool pump-trap wrench system of claim 1 wherein said handle of said handle-frame is configured in a semi-arch-shape to enhance comfort and ergonomics for said user.

14. The pool pump-trap wrench system of claim 1 wherein said pool pump-trap wrench assembly further comprises a distinct color-coding of select surfaces to provide said user with a quick-reference as to a specific placement of said pool pump-trap wrench system on each of one of said pool pump-trap covers.

15. A method of using a pool pump-trap wrench system comprising the steps of:

providing the pool pump-trap wrench system of claim 1;

locating one of pool pump-trap covers;

affixing a pool pump-trap wrench assembly to said pool pump-trap cover;

untorquing said pool pump-trap cover via the pool pump-trap wrench assembly; and removing said pool pump-trap cover.

16. The method of claim 15 further comprising the steps of:

cleaning and maintaining said pool pump-trap;

replacing said pool pump-trap cover onto said pool pump-trap;

retorquing said pool pump-trap cover via said pool pump-trap wrench assembly; and removing said pool pump-trap wrench assembly from said pool pump-trap cover.

17. A pool pump-trap wrench system for cleaning and maintaining a wide variety of pool pump-traps comprising:

a pool pump-trap wrench assembly comprising;

a handle-frame comprising a handle; and a frame including a frame-opening for accommodating a portion of a pool pump-trap cover, at least one frontward-notch, and at least one rearward-notch;

a top-unit comprising a front-member and a rear-member configured for engaging portions of a pool pump-trap cover, and a center-section comprising a body, and a body-opening; and two offset-lower-levers;

wherein said pool pump-trap wrench system comprises said pool pump-trap wrench assembly;

wherein said pool pump-trap wrench assembly comprises said handle-frame, said top-unit, and said two offset-lower-levers in functional and structural combination;

wherein said handle-frame comprises said handle, and said frame in functional and structural combination;

wherein said frame comprises said frame-opening, said at least one frontward-notch, and said at least one rearward-notch in functional and structural combination;

wherein said top-unit comprises said front-member, said rear-member, and said center-section in functional and structural combination; and wherein said handle-frame, said a top-unit, and said two offset-lower-levers are structured and arranged in combination to provide a user with a device useful for affixing to a wide variety of pool pump-trap covers for cleaning and maintaining a pool pump-trap;

wherein said pool pump-trap wrench assembly is constructed of a single-molded material;

wherein said single-molded material is a plastic such that said pool pump-trap wrench system is lightweight;

wherein said plastic is formulated to be resistant to ultra-violet light degradation;

wherein said handle of said handle-frame further includes a texture to provide said user with increased grippability during use of said pool pump-trap wrench assembly;

wherein said handle-frame further comprises an aperture to allow said user to hang said pool pump-trap wrench assembly for storage;

wherein said handle-frame further comprises reinforcing veins to further increase structural rigidity and durability;

wherein said top-unit further includes a plurality of first-openings to decrease an overall mass of said pool pump-trap wrench assembly;

wherein said top-unit further comprises at least one button useful for providing increased affixability to at least one of said pool pump-trap covers;

wherein said handle-frame further comprises a plurality of second-openings to decrease an overall mass of said pool pump-trap wrench assembly;

wherein each of said two offset-lower-levers further comprise a textured-face to enhance affixability to at least one of said pool pump-trap covers;

wherein said handle of said handle-frame is configured in a semi-arch-shape to enhance comfort and ergonomics for said user.

18. The pool pump-trap wrench system of claim 17 further comprising a kit including said pool pump-trap wrench assembly, and a set of user instructions.

* * * * *